US005195412A

United States Patent [19]

Flemming et al.

[11] Patent Number: 5,195,412

[45] Date of Patent: Mar. 23, 1993

[54] NOTCHING AND SHEARING MACHINE FOR EXTERIOR SIDING PANELS AND METHOD OF USING SAME

[75] Inventors: Peter D. Flemming; Douglas M. Hawkinson; Douglas W. Stout, all of McPherson; Robert T. Fry, Hutchinson, all of Kans.

[73] Assignee: Plastics Extrusion Machinery, McPherson, Kans.

[21] Appl. No.: 764,499

[22] Filed: Sep. 20, 1991

[51] Int. Cl.[5] ..... B26D 1/60; B26D 9/00

[52] U.S. Cl. ..... 83/37; 83/150; 83/160; 83/300; 83/301; 83/320; 83/405; 83/406; 83/638; 83/683; 83/693; 83/917

[58] Field of Search ..... 83/37, 150, 160, 300, 83/301, 320, 405, 406, 638, 683, 692, 693, 917

[56] References Cited

U.S. PATENT DOCUMENTS 3,620,114 11/1971 Chudyk ..... 83/406 X
3,656,385 4/1972 Kimbrell ..... 83/300 X
4,179,962 12/1979 Crump ..... 83/300

FOREIGN PATENT DOCUMENTS 0977119 12/1982 U.S.S.R. ..... 83/37

*Primary Examiner*—Douglas D. Watts
*Assistant Examiner*—Raymond D. Woods
*Attorney, Agent, or Firm*—Kokjer, Kircher, Bowman & Johnson

[57] ABSTRACT

A cutoff system for exterior siding which includes a flying punch and shear. The system includes a main carriage which is adapted to reciprocate and, in one direction of travel, move at the same speed as the siding to be cut. A pair of punches are then actuated to form the hanger and butt notches at the lateral edges of the siding. Upon withdrawal of the punches, the travel of the main cylinder is slowed such that the siding travels away from the punching area. Upon sensing the notched areas, the main carriage is again moved to travel at the same speed as the siding. The speed is timed such that the center of the notches is located below a shear. This shear is then actuated to form a single parting line across the siding. The carriage is then retracted to await the next cycle of the system. As such, with each cycle of the system, the notches are formed in the trailing and leading edges of adjacent panel segments, and the leading panel segment cut from the continuous siding.

12 Claims, 2 Drawing Sheets

NOTCHING AND SHEARING MACHINE FOR EXTERIOR SIDING PANELS AND METHOD OF USING SAME

BACKGROUND OF THE INVENTION

1. Field of the Invention

The present invention relates in general to flying shears and punches. In particular, the present invention relates to an improved cutoff device for notching and shearing exterior siding panels.

2. Description of the Related Art

Exterior siding panels of aluminum, steel and plastic for application to buildings have been known for many years. It is often the case that the siding panels are produced as a continuous strip of material which is cut to the appropriate length and shape.

In particular, the longitudinal ends of most siding panels are not simply a straight shear line, but include notches along the lateral edges which open onto the longitudinal ends of the panel section. The upper notch is typically referred to as a hanger notch, while the lower notch is typically referred to as a butt notch. As noted above, each of these notches extends into each longitudinal end of each siding panel.

To form these notches and to cut the panels to the proper length, it has been common in the art to employ a single punching operation. In particular, a flying punch was employed which traveled with the uncut panel to match its speed. Once the speed was matched, the punch was actuated to remove a slug from the length of panel. The punch and die, and thus the slug, was in the general shape of an "I". In this manner, the upper and lower cross bars of the "I" would form the hanger and butt notches of adjacent ends of two panels. The elongated member connecting these cross bars would serve to separate the adjacent ends of the two panels.

While this arrangement provides the proper notches and panel cutoff, several problems are associated with this system. First, the slug produced by the previous system produces waste in materials. Specifically, the width of the elongated member connecting the crossbars in the "I" slug is all wasted material, as it is merely desired to separate the panels along this line. Additionally, the portion of the crossbars which correspond to the width of the elongated member is also waste. Second, the shape of the slug makes it very difficult to eject from the punch, which can result in the slug hanging up in the system. This may eventually cause a malfunction and interrupt production of the siding while the jam is cleared. Finally, the irregular shape of the slug also makes it difficult to recycle. The "I" slugs often become entangled in the recycling (grinding) machines, causing such machines to jam. This difficulty in recycling has often led to the slugs merely being discarded which is detrimental to the environment and a waste of resources.

SUMMARY OF THE INVENTION

An object of the present invention is to provide a cutoff system for exterior siding which provides the proper end configuration with minimal waste.

Another object of the present invention is to provide a cutoff machine for siding which produces slugs which are easily ejected and recycled.

These and other objects are achieved by a cutoff system for exterior siding which includes a flying punch and shear. The system includes a main carriage which is adapted to reciprocate and, in one direction of travel, move at the same speed as the siding to be cut. A pair of punches are then actuated to form the hanger and butt notches at the lateral edges of the siding. Upon withdrawal of the punches, the travel of the main cylinder is slowed such that the siding travels away from the punching area. Upon sensing the notched areas, the main carriage is again moved to travel at the same speed as the siding. The speed is timed such that the center of the notches is located below a shear. This shear is then actuated to form a single parting line across the siding. The carriage is then retracted to await the next cycle of the system. As such, with each cycle of the system, the notches are formed in the trailing and leading edges of adjacent panel segments, and the leading panel segment cut from the continuous siding.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
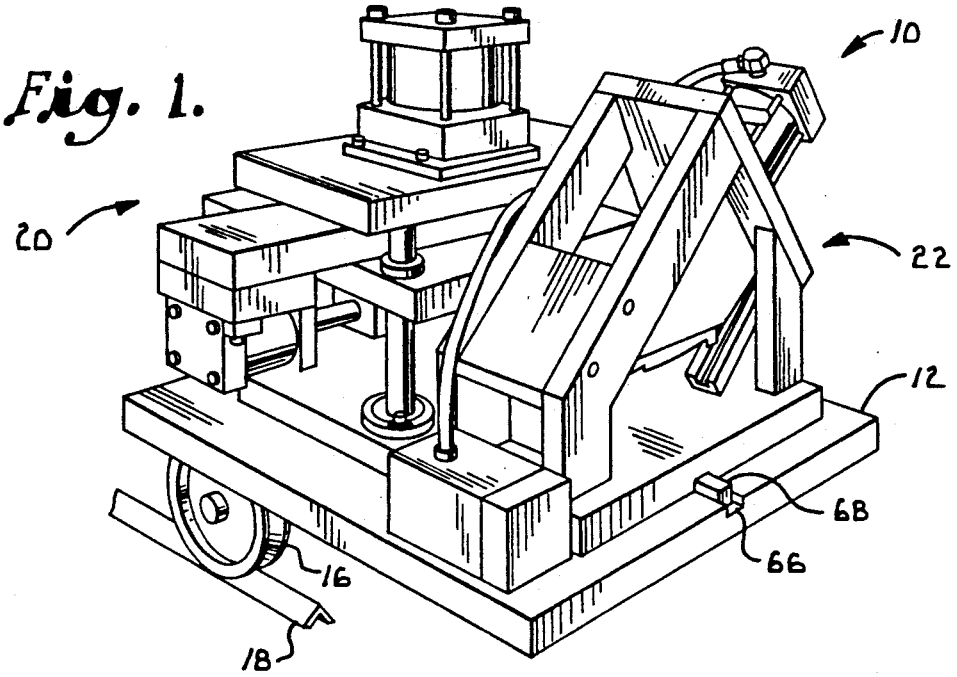
FIG. 1 is a perspective view of the system according to the present invention.

With reference to FIG. 1, the device according to the present invention is generally designated by reference numeral 10. The device is employed to notch and shear a continuous segment of exterior siding into discreet siding panels. The siding will travel from the upper left hand of FIG. 1 towards the lower right hand of FIG. 1 and will pass through the device 10 as will be apparent from the discussion below.

The device includes a main carriage 12 which has four wheels 16 (one of which is shown) rotatably mounted thereto to support the carriage. The carriage 12 is preferably guided in its movement upon a pair of rails 18 upon which the wheels 16 travel to ensure that the carriage travels in a direction parallel to the continuous siding advance. The wheels have an appropriate periphery which engages with the rails 18 to allow the carriage to reciprocate there along.

Mounted upon the main carriage 12 are a punch assembly 20 and a shear assembly 22.

Figure 2:
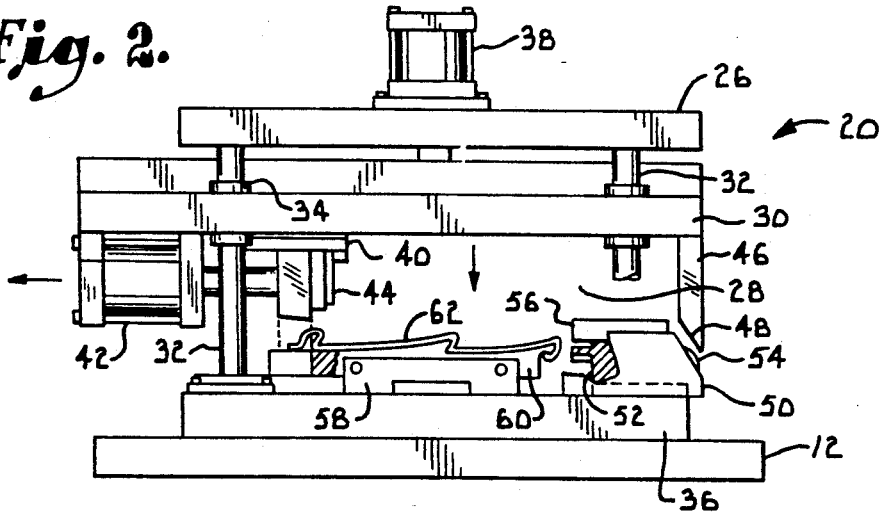
FIG. 2 is a front view of the punching section of the system.

With reference to FIG. 2, the punch assembly 20 is shown. The punch assembly 20 includes four guide rods which support a top panel 26. The guide rods 32 support the top panel 26 in spaced relation from the punch base 36 to define a cavity 28 through which the continuous siding may pass.

Disposed between the top panel 26 and punch base 36 is a punch ram 30. Fixed to the punch ram 30 are a plurality of bushings 34 (one of which is shown) which slide upon the guide rods. The guide rods 32 and bushings 34 serve to allow the punch ram 30 to reciprocate substantially perpendicular to the direction of advance of the continuous siding. To effect this reciprocation, a punch cylinder 38 is fixed to the top panel 26 with the piston rod thereof extending through the top panel 26 and fixed to the punch ram 30. As such, actuation of the punch cylinder will cause movement of the punch ram 30.

Mounted upon the punch ram 30 is a hanger punch guide 40 and a hanger punch cylinder 42. The hanger punch guide 40 allows horizontal reciprocation of a hanger punch 44 which is received within the punch guide 40. This reciprocation is preferably substantially perpendicular to the direction of advance of the continuous siding. The hanger punch cylinder 42 includes a piston rod which is connected to the hanger punch 44 to cause reciprocation of the punch for a purpose described below.

Also connected to the punch ram 30 is a cam finger 46. The cam finger 46 extends downwardly from the punch ram and includes a tapered free end forming an inclined cam surface 48.

Fixed to the punch base 36 is a butt punch guide 50. The guide 50 allows horizontal reciprocation perpendicular to the direction of advance of the continuous siding. Mounted for such reciprocation within the guide 50 is a butt punch 52. Punch 52 includes at the exterior end thereof (opposite to that of the punch) a roller 54. The roller 54 is adapted to be engaged by the cam surface 48 such that downward movement of the punch ram will cause a butt punch 52 to move inwardly. Retraction of the butt punch 52, upon upward movement of the punch ram 30, may be effected by appropriate coil or leaf springs (not shown). The butt punch 52 may include a blocking plate 56 which extends above the continuous siding during actuation of the butt punch 52 to ensure that the siding does not move upwardly and is retained in the proper position for punching.

The punch assembly 20 is also provided with an appropriate die. Specifically, mounted upon the punch base 36 is a die holder 58 which in turn removably mounts a die 60. The upper surface of the die 60 includes appropriate cavities and protuberances to substantially correspond to the cross-sectional configuration of the lower side of the continuous siding. This siding is identified in FIG. 2 by reference number 62. As may be seen, the major portion of the cross sectional configuration of the siding is that of a sawtooth with one edge of each tooth being longer than the other. This provides a shingle-like appearance when the panel is installed on the building with the longer sides of the sawteeth uppermost.

Upon actuation of the punch cylinder 38, the punch ram 30 is driven downward. This will cause the hanger punch 44 to pass through the upper lateral edge of the continuous siding and into an appropriate notch in the die 60. Additionally, the downward motion of the punch ram 30 will cause the cam surface 48 to engage with the roller 54 to move the butt punch 52 inwardly through the lower lateral edge of the continuous siding and into an appropriate notch in the die 60.

Prior to upward movement of the punch ram, the hanger punch cylinder 42 is actuated to move the hanger punch 44 from the extended position shown in FIG. 2 to a retracted position. This will cause the hanger slug produced by the punch 44 to be cleared from the die 60 and moved away from the continuous siding. The butt slug formed by the punch 52 will fall downwardly through an appropriate exit hole in the punch base 36 and carriage 12. The piston rod of the punch cylinder 38 may then be retracted to move the punch ram 30 upwardly. This will cause the punches 44 and 52 to be fully disengaged and withdrawn from the siding 62 at which point the hanger punch cylinder 42 may be moved to the extended position to bring the hanger punch 44 into the proper position for the next punching operation.

Figure 3:
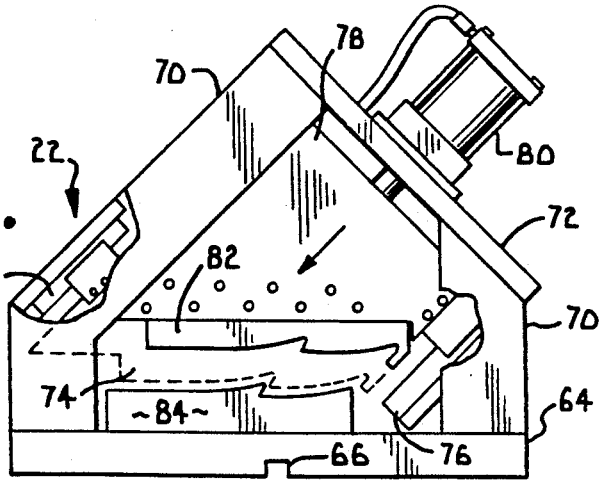
FIG. 3 is a front view of the shearing section of the system.

With regard to FIG. 3, the shear assembly 22 is shown. The shear assembly is mounted upon the carriage 12, preferably for adjustment. To this end, the carriage 12 and a shear base 64 each include appropriate keyways 66 into which a key 68 may be inserted. The keyways are preferably formed substantially parallel to the direction of advance of the siding. The keyways will thus allow adjustment of the position of the shear assembly with respect to the punch assembly 20.

The shear assembly 22 includes a set of side bars 70 which support a top panel 72 at a position spaced from the shear base 64 such that a cavity 74 is formed through which the continuous siding may pass. Unlike the punch assembly, however, the side bars 70 and top panel 72 are arranged oblique to the horizontal and vertical axes for a reason made clear below.

Connected to each of the side bars 70 is a shear guide 76. The shear guides, like the side bars 70, are formed at an angle with respect to the vertical. A shear plate 78 is mounted between the shear guides 76 for reciprocation therein. Due to the angled nature of the shear guides, the shear plate 78 will therefore reciprocate along a direction which includes both horizontal and vertical components. To allow this reciprocation, a shear cylinder 80 is mounted to top panel 72, with the piston rod of cylinder 80 extending through the top panel and being fixed to the shear plate 78.

Attached to the lower edge of the shear plate 78 is an upper shear blade 82 which is adapted to cooperate with a lower shear blade 84, mounted on shear base 64, to perform a slugless shearing operation upon a single part line on the continuous siding. The upper and lower shear blades have a configuration which substantially corresponds to the cross-sectional configuration of the continuous siding to provide adequate support during the shearing operation to prevent undue deformation of the siding which may be detrimental to the appearance or function of the final product.

As may be readily envisioned, actuation of the shear cylinder 80 will cause the shear plate 78 and upper shear blade 82 to travel towards the lower shear blade 84 to cut the continuous siding with a scissors-like action to further reduce the deformation of the final product. It is preferred that the horizontal component of the shear reciprocation be directed towards the upper lateral edge of the continuous siding to reduce the possibility that the shingle-like protrusions in the siding will be flattened.

To ensure that the punching and shearing are performed at the proper locations and provide accurate notches and cuts, the carriage 12 travels along the rails 18 to match speeds with the advancing siding. The movement of the carriage is effected by a main travel cylinder 92 and a shear travel cylinder 69. Specifically, the main travel cylinder is fixed to the ground and includes a piston rod connected to the carriage 12. This piston rod is not directly connected to the carriage, however, but is connected to a cylinder bracket 85, which is in turn connected to the piston rod of the shear travel cylinder 69. The shear travel cylinder is then finally directly connected to the carriage 12. As such, it may be seen that expansion or contraction of either the main travel cylinder or the shear travel cylinder will cause movement of the carriage 12.

The operation of the device according to the present invention will now be described with reference to FIG. 4.

Figure 4:
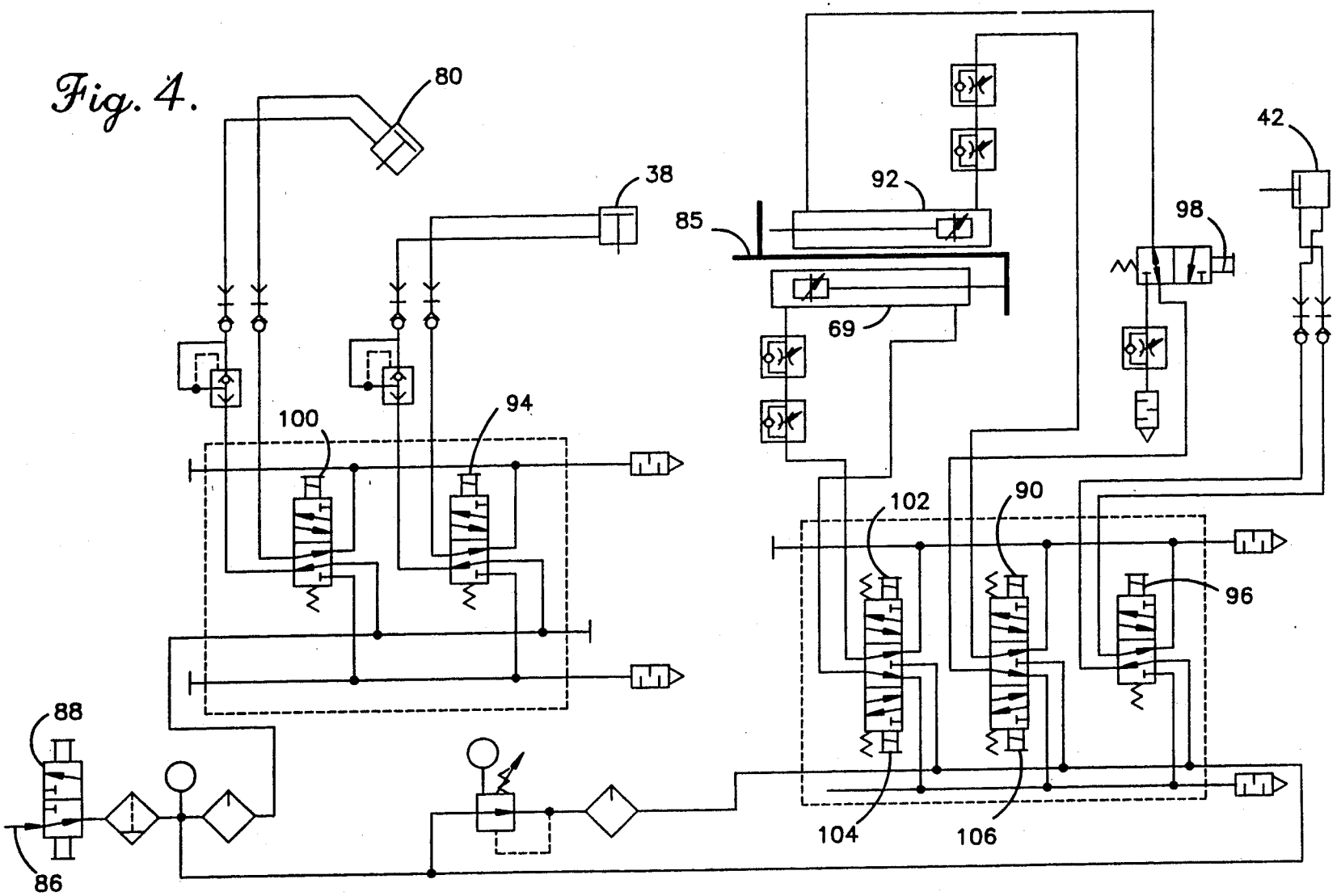
FIG. 4 is a pneumatic control diagram for the system.

In the lower left hand corner of FIG. 4, an air supply line 86 leads into the system and passes through a main on/off valve 88 and appropriate regulators, filters etc. With valve 88 in the position shown in FIG. 4, pressurized air may flow into the various lines to allow operation of the system. Prior to operation, the continuous siding will be fed through the cavities 28 and 74 with the siding positioned to ride along the protuberances of the die 60 and lower shear blade 84. The system will be actuated at intervals, with these intervals being determined by an appropriate timer or distance gauge such that the proper length of siding panels are produced by the device.

Upon the receipt of an actuating signal, a main travel solenoid 90 is actuated to provide pressure to main travel cylinder 92. Upon pressurized air being introduced by the main travel solenoid 90, the piston rod of the main travel cylinder 92 will begin to extend, moving the carriage 12 in the direction of advance of the continuous siding. At this time, a notching cylinder down timer (not shown) begins counting and a notching down solenoid 94 is actuated. Actuation of this solenoid feeds pressurized air to the punch cylinder 38 driving the punch ram 30 downwardly to cause the punches 44 and 52 to form the hanger and butt notches in the continuous siding. It should be noted that the actuation of solenoid 94 may take place at the same time as actuation of main travel solenoid 90, or at a slightly later time, to allow the main carriage to achieve a speed equal to that of the advancing siding.

After a specified period of time, the notching cylinder down timer is exhausted and causes a hanger notch removal timer to begin counting. This causes a hanger notch removal solenoid 96 to be actuated causing the hanger punch cylinder 42 to be retracted and thus clear the hanger slug from the advancing siding. Upon exhaustion of the hanger notch removal timer, the notching down solenoid 94 is deactivated causing the punch cylinder 38 to retract to the upper position. Movement of the cylinder 38 to its upper position causes a reed switch to be activated which deactivates the hanger notch removal solenoid 96. This causes the hanger punch cylinder 42 to extend to its outer position, such that the hanger punch 44 is again ready to perform a punching operation.

Activation of the reed switch also causes the actuation of a slow travel solenoid 98 which restricts the flow of air out of the main travel cylinder 92, slowing the carriage speed.

As the carriage speed slows, and eventually stops at the full extension of main travel cylinder 92, the continuous siding will advance with respect to the main carriage 12. As such, the notched portions in the continuous siding will advance from the punch assembly 20 towards the shear assembly 22. Just prior to the shear assembly 22 is located a photoelectric cell (not shown) which senses the notched area in the continuous siding. When the photoelectric cell senses this notched area, a shear delay timer (or counter) begins counting. At the exhaustion of the shear delay timer (or counter) a shear travel solenoid 102 is actuated which in turn activates the shear travel cylinder 69 causing the carriage 12 to advance. A shear solenoid 100 is also actuated. Actuation of solenoid 100 causes the shear cylinder 80 to be activated, driving the shear plate 78 and upper blade 82 into and through the continuous siding, thus forming a siding panel from the leading end of the continuous siding. The shear delay timer (or counter) is, of course, set such that the shear line is substantially centered within the notched portion of the continuous siding. Adjustment of the shear assembly on the carriage 12 may also provide the proper position.

Exhaustion of the shear delay timer also causes a shear timer to begin counting. The exhaustion of this shear timer causes the deactivation of shear solenoid 100, causing the shear cylinder, and thus the shear plate 78 and upper blade 82 to be retracted from the advancing continuous siding.

When the shear cylinder 80 reaches its fully retracted position, a shear cylinder retraction reed switch (not shown) is activated which in turn causes the shear carriage return solenoid 104 to be activated which brings the shear travel cylinder 69 to its initial retracted position. Upon the shear cylinder 69 reaching its retracted position, a shear travel reed switch (not shown) is energized. Energization of this read switch causes the slow travel solenoid 98 to be deactivated and activates a carriage return solenoid 106. This causes the main travel cylinder 92 to be retracted, thus bringing the carriage 12 back to its initial position in an expedited manner. Upon the main travel cylinder 92 reaching its fully retracted position, a carriage return reed switch (not shown) is energized, indicating that the system has fully cycled and is ready to begin a new cycle.

While the present invention has been described with regard to a pneumatic and electrical control system, it should be readily apparent to those skilled in the art that hydraulics and/or electric motors may also be employed to effect the various movements required of the system. Additionally, where a pneumatic system is employed the present system may alternatively include a control system different than that shown in FIG. 4. It should also be noted that the present invention may include different punch and die arrangements for different types of siding or different siding requirements.

From the foregoing it will be seen that this invention is one well adapted to attain all ends and objects herein above set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for notching and shearing continuous exterior siding to form panels, comprising:

a carriage adapted to reciprocate in a direction substantially parallel to a direction of advance of the siding;

means for reciprocating said substantially parallel carriage in said direction between a retracted punch position and an extended shear position, and intermediate said positions said carriage passing through an extended punch position and a retracted shear position, said retracted shear position being intermediate said extended shear position and said extended punch position;

a punch assembly mounted on said carriage and including a die and at least one punch adapted to cooperate with said die to form at least one notch in the siding;

means for activating said punch to cooperate with said die;

a shear assembly mounted on said carriage downstream, in said substantially parallel direction, of said punch assembly and including a shear adapted to cut the siding into the panels at a position substantially intermediate the notch cut by said punch assembly;

means for activating said shear to cut the siding; and control means for said reciprocating means, punch activating means and shear activating means, said control means activating said carriage reciprocating means for moving said carriage from said retracted punch position towards said extended punch position and operating said means for activating said punch at or prior to said carriage reaching said extended punch position, causing reciprocating means to have a speed less than that of the siding to allow relative movement between said carriage and the siding in said substantially parallel direction, subsequently activating said carriage reciprocating means for moving said punch from said retracted shear position to said extended shear position and operating said means for activating said shear at or prior to said carriage reaching said extended shear position to thereby cut the siding at the position substantially intermediate the notch, and thereafter operating said means for reciprocating to move said carriage from said extended shear position to said retracted punch position.

2. An apparatus as in claim 1, wherein said die includes siding supporting portions having a configuration substantially corresponding to at least a substantial portion of the siding along a cross sectional plane substantially normal to the direction of advance.

3. An apparatus as in claim 2, wherein said shear includes upper and lower blades, each having an edge configuration substantially corresponding to the cross sectional configuration of the siding.

4. An apparatus as in claim 3, the siding including a plurality of triangular sawtooth-type protrusions in cross section, one edge of each protrusion being substantially longer than the other, and wherein said shear reciprocates in a direction having vertical and horizontal components and making a smaller angle with respect to the longer edge than to the shorter edge.

5. An apparatus as in claim 3, wherein said punch assembly includes two said punches adapted to cooperate with said die to form notches in lateral edges of the siding prior to operation of said shear.

6. An apparatus as in claim 5, wherein said punch assembly includes a punch ram adapted to reciprocate in a first direction, and a first punch and a cam finger both mounted on said punch ram in spaced relation for travel therewith in said first direction, said first punch thereby cooperating with said die, and a second punch mounted on said punch assembly for reciprocation in a direction substantially perpendicular to said direction of advance, said cam finger adapted to engage said second punch to cause said reciprocation.

7. An apparatus as in claim 1, wherein said extended punch position substantially corresponds to said retracted shear position, and wherein said control means waits a predetermined period of time after said carriage reaches said extended punch position prior to said activating of said carriage reciprocating means for moving said carriage from said retracted shear position to said extended shear position.

8. An apparatus as in claim 7, wherein said means for reciprocating said carriage comprises a first piston and cylinder pair adapted to move said carriage between said retracted and extended punch positions, one of said first piston and cylinder pair being connected to the ground and the other of said first piston and cylinder pair being connected to one of a second piston and cylinder pair, the other of said second piston and cylinder pair being connected to said carriage, and said second piston and cylinder pair being adapted to move said carriage between said retracted and extended shear positions.

9. A method of notching and shearing continuous exterior siding to form panels, comprising the steps of:

advancing a carriage in a direction substantially parallel to a direction of advance of the siding toward an extended punch position;

punching the siding with a punch mounted on said carriage to form at least one notch therein;

allowing the siding to advance with respect to said carriage;

again advancing said carriage, in a direction substantially parallel to the direction of advance toward an extended shear position; and shearing the siding at a position substantially intermediate said at least one notch with a shear mounted on said carriage to thereby form one of the panels.

10. A method as in claim 9, wherein said steps of advancing said carriage to a punch position and punching are performed substantially simultaneously, and said steps of again advancing said carriage to a shear position and shearing are performed substantially simultaneously and subsequent to said punching.

11. A method as in claim 10, wherein said step of punching comprises punching two notches into the siding at lateral edges thereof.

12. A method as in claim 11, wherein said two notches are punched substantially simultaneously.

* * * * *